United States Patent [19]

Raudat et al.

[11] 4,207,721

[45] Jun. 17, 1980

[54] FINGER ASSEMBLY FOR CASE LOADER

[75] Inventors: John L. Raudat, North Madison, Conn.; Adam Z. Rydell, Decatur, Ga.

[73] Assignee: Standard-Knapp, Inc., Portland, Conn.

[21] Appl. No.: 963,363

[22] Filed: Nov. 24, 1978

[51] Int. Cl.[2] ..... B65B 21/16

[52] U.S. Cl. ..... 53/248; 53/262

[58] Field of Search ..... 53/248, 260, 261, 262

[56] References Cited

U.S. PATENT DOCUMENTS

| | | | |
|---|---|---|---|
| 4,033,095 | 7/1977 | Wild | 53/248 |
| 4,035,986 | 7/1977 | Clem et al. | 53/248 X |

*Primary Examiner*—Travis S. McGehee

*Attorney, Agent, or Firm*—McCormick, Paulding & Huber

[57] ABSTRACT

A finger assembly includes a finger holder supported in depending position on a horizontal rail for adjustable positioning therealong. Flexible fingers received in associated slots in the holder extend downwardly and laterally outwardly from the holder and are clamped thereto by a retaining member, positioned below the holder, and a single clamping screw, extending upwardly through the retaining member and engaged with and secured to the holder. Different size retaining members may be used to vary the lateral pitch of the fingers. A single finger may be removed from the holder for repair or replacement by loosening the clamping screw which is accessible from the position below the holder.

11 Claims, 7 Drawing Figures

Fig. 1
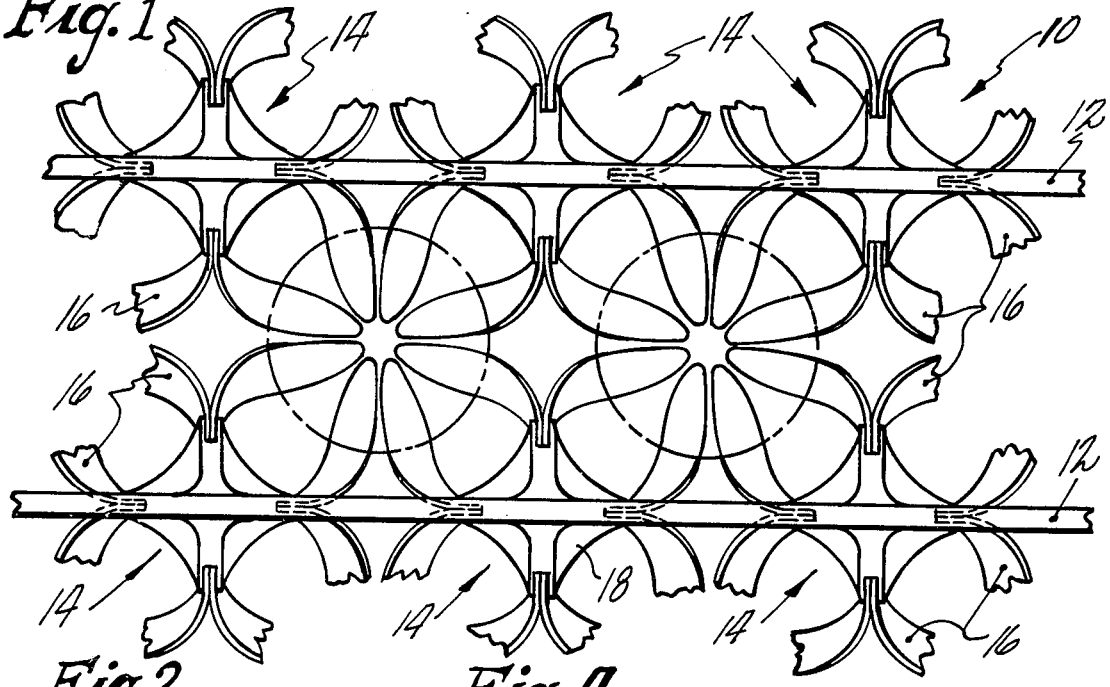
Fig. 2
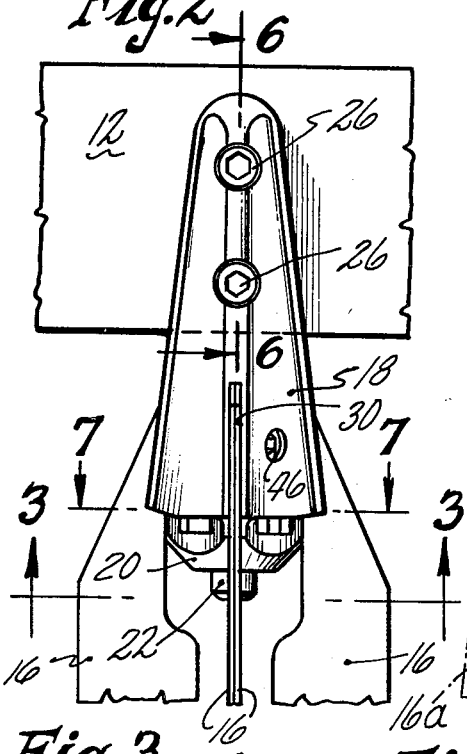
Fig. 4
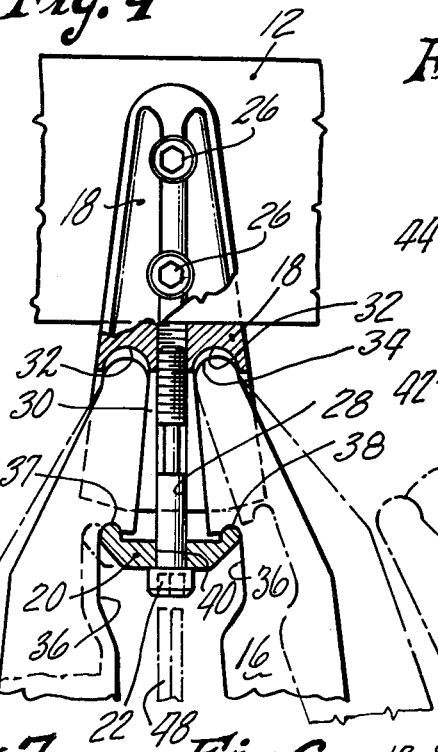
Fig. 5
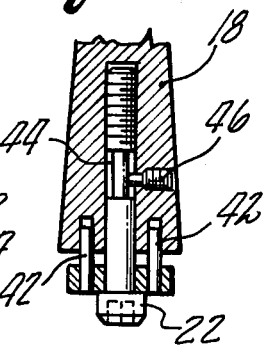
Fig. 3
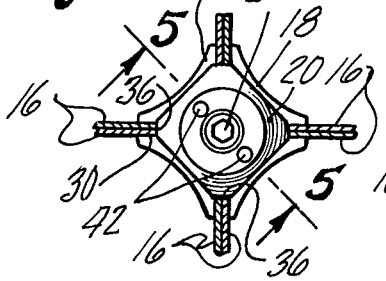
Fig. 7
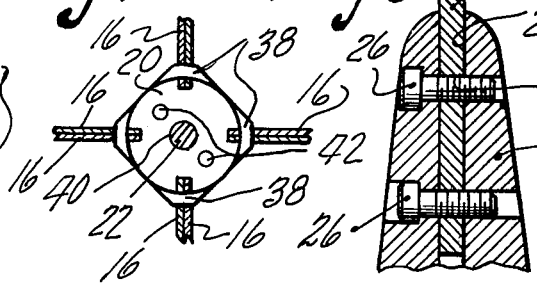
Fig. 6

FINGER ASSEMBLY FOR CASE LOADER

BACKGROUND OF THE INVENTION

This invention relates in general to case loading machines of the type which include a grid assembly and deals more particularly with an improved finger assembly for such a machine.

A machine of the aforedescribed type is generally used to pack articles of uniform size and shape, as for example, bottles, cans and the like in cases or containers which may be provided with compartments or cells for holding individual articles. A charge of articles to be loaded is accumulated in a grid frame, which comprises a part of the grid assembly, and is discharged through it into a case. Finger assemblies of the type with which the present invention is concerned, and which also comprise a part of the grid assembly, are usually supported below the grid frame and cooperate to define chutes which control the gravity fall of the charge as it drops from the frame into a case. Both the grid frame and the various finger assemblies associated with it must be adjustable in both longitudinal and transverse directions to accommodate articles of varying size and to vary packing patterns. Since the flexible fingers which comprise the finger assemblies may become damaged or broken by being repeatedly struck by falling charges and cases moving into and out of loading position, it is desirable that these flexible fingers be readily replaceable to minimize machine down time when damage or breakage does occur. Heretofore, various finger assemblies have been provided wherein individual fingers may be released and removed from assembly from a position of the grid assembly. However, the arrangement of the grid frame in some case loading machines is such that access to the finger assemblies from above may be difficult. Accordingly, it is the general aim of the present invention to provide an improved finger assembly for adjustable mounting on a part of a case loader and which facilitates removal of a single finger from a group of fingers comprising an assembly and from a position below the assembly.

SUMMARY OF THE INVENTION

In accordance with the present invention an improved finger assembly for a case loader is provided which includes a vertically elongated finger holder having at least one vertically disposed finger receiving slot which includes a blind upper end portion defining a generally downwardly facing clamping surface. The slot opens laterally outwardly through a side of the holder and downwardly through its lower end. The assembly further includes at least one flexible finger. The one finger is received in the one slot and has an end portion received in the blind portion of the slot and another portion exposed below the lower end of the holder. A finger retaining member positioned below the holder has an upwardly facing clamping surface which engages the other portion of the one finger. A single clamping fastener extends upwardly through the retaining member and is engaged with the holder and secured thereto. The clamping screw maintains the clamping surfaces on the holder and on the retaining member in clamping engagement with the one finger which extends downwardly and outwardly from the holder. Means is provided for adjustably mounting the holder on an associated part of a case loader.

BRIEF DESCRIPTION OF THE DRAWING

FIG. 1 is a fragmentary plan view of a portion of a case loader having finger assemblies embodying the present invention.

FIG. 2 is a somewhat enlarged fragmentary side elevational view of a portion of the case loader shown in FIG. 1.

FIG. 3 is a fragmentary sectional view taken along the line 3—3 of FIG. 2.

FIG. 4 is similar to FIG. 2, but shows a portion of the finger assembly in vertical section and the clamping screw and retaining member in released position.

FIG. 5 is a fragmentary sectional view taken along the line 5—5 of FIG. 3.

FIG. 6 is a fragmentary sectional view taken along the line 6—6 of FIG. 3.

FIG. 7 is a fragmentary sectional view taken along the line 7—7 of FIG. 3.

DETAILED DESCRIPTION OF PREFERRED EMBODIMENT

Turning now to the drawing, a portion of a case loading machine embodying the present invention is shown in FIG. 1 and indicated generally by the reference numeral 10. The machine 10 has a grid assembly which includes a grid frame (not shown) and a plurality of mounting rails 12, 12 which are supported below the frame and which usually extend horizontally and in the direction of article flow. The rails are supported on the machine for adjustment so that the spacing between adjacent rails may be varied to accommodate articles of varying width which must pass downwardly therebetween. As illustrated each rail carries a longitudinally spaced series of finger assemblies, indicated generally at 14, 14, which embody the present invention. The finger assemblies 14, 14 are releasably secured to the rails 12, 12, and may be adjustably positioned therealong whereby the longitudinal spacing between adjacent finger assemblies in the series may be varied to accommodate articles of varying size, as will be hereinafter further discussed. In accordance with the present invention, each finger assembly includes at least one flexible finger, however, the number of fingers in the assembly may vary and in some instances will be determined by the position of the assembly within an array of finger assemblies which cooperate to form channels or chutes for controlling the drop of an article charge. Each of the finger assemblies 14 in the portion of the array shown in FIG. 1 has eight depending resilient flexible fingers indicated at 16, 16. The fingers 16, 16 of adjacent assemblies 14, 14 cooperate to define article defining chutes for controlling the gravity fall of articles, such as indicated at A, A in FIG. 1. A typical grid assembly is shown in U.S. Pat. No. 3,561,189 to Raudat, assigned to the assignee of the present application, and hereby adopted by reference in its entirety. Reference may be had to the aforesaid patent for further disclosure of a grid assembly.

Referring now to FIGS. 2–5, a typical finger assembly 14 includes a finger holder 18, a finger retaining member 20 and a single fastener or clamping screw 22 which extends upwardly through the retaining member 20 and which cooperates with it and with the holder to releasably secure each finger 16 in a downwardly and outwardly extending position relative to the finger holder 18, substantially as shown in FIG. 2, wherein the clamping screw 22 is shown it its clamping position.

Considering now the assembly 14 in further detail, the illustrated finger holder 18 comprises a vertically elongated and upwardly tapered fluted member having a somewhat obelisk form and characterized by smoothly contoured surfaces. A slot 24 which extends transversely through and bisects the upper part of the holder is adapted to receive an associated part of a rail 12. A pair of clamping screws 26, 26 extend transversely through the holder 18, pass through associated holes 27, 27 in the rail 12, and threadably engage the holder to clampingly secure it in selected position to a rail 12, as shown in FIG. 6. A additional holes 27, 27 (not shown) may be provided in the rail 12 to facilitate attachment of the holder 18 to the rail in other positions therealong. A vertical bore 28 extends axially upwardly through the lower part of the holder and has a smooth lower end portion and a threaded upper end portion for receiving and engaging the clamping screw 22, as best shown in FIG. 4.

In accordance with the present invention the finger holder 18 has at least one vertically disposed finger receiving slot 30 which opens laterally outwardly through a side of the holder and downwardly through the lower end of the holder to receive at least one finger. However, since the illustrated assembly 14 includes eight fingers 16, 16 it is provided with four finger receiving slots 30, 30, each of which receives two fingers. The slots 30, 30 are spaced equiangularly about the central axis of the bore 28 and intersect the bore, substantially as shown in FIGS. 4 and 5. Each slot 30 has a blind upper end portion which defines an arcuate generally downwardly facing clamping surface 32, as shown in FIG. 4. At this point it should be noted that the fluted holder 18 is provided with four flutes. Each flute extending longitudinally of the holder and is disposed between a pair of adjacent finger receiving slots 30, 30, as best shown in FIG. 3.

The flexible fingers 16, 16 are preferably made from resilient metal and may vary in shape. The particular configuration of the lower portion of the fingers may be determined, at least to some degree, by the physical characteristics of the article to be packed. However, the upper end portion of each finger 16 is shaped substantially as shown in FIG. 4. Specifically, the upper end portion of each finger, indicated at 34, has a radial contour which generally complements the arcuate radial contour of an associated clamping surface 32. Each blade 16 also has another portion 36 which is recessed and exposed below the lower end of the holder 18 when the blade is in its clamped position, as will be hereinafter further discussed. The recessed portion 36 includes a radially contoured notch 37, substantially as shown.

The retaining member 20 serves both to clamp the fingers 16, 16 to the holder 18 and to target the tips of the fingers on the center of a carton cell therebelow, for example, to assure proper article positioning, as will be hereinafter further evident. The retaining member may be symmetrical or asymmetrical, as required to properly target the fingers. However, the illustrated retainer 20 has a generally square cross section, as viewed from below, and is wholly disposed within the peripheral bounds of the holder, as best shown in FIG. 3. The retaining member is provided with at least one radial arcuate upwardly facing clamping surface 38 for generally complementary engagement with an arcuate notch 37 on an associated finger 16. A bore 40 formed in the retaining member 20 to receive the clamping screw 22. At least one upwardly projecting retaining pin 42, carried by the retaining member 20, is adapted to be received in an associated hole in the lower end of the holder 18, as best shown in FIG. 5. The clamping screw 22 extends upwardly through the bore 40 in the retaining member and threadably engages the upper end of the bore 28 in the holder. An annular groove 44 of substantially axial extent is formed in the clamping screw 22 intermediate its ends. A set screw 46 threaded into the holder extends inwardly beyond the bore 28 and into the annular groove 44, as shown in FIG. 5, and permits separation of the clamping screw and the retaining member from the holder.

When it becomes necessary to repair or replace one or more of the fingers 16 which comprise the assembly 14, the socket head clamping screw 22 which is accessible from below is loosened to its releasing position of FIG. 4 with a tee handle wrench or the like, such as shown at 48. The retaining screw 46 limits the travel of the clamping screw 22 relative to the holder so that the clamping screw and the retaining member 20 will not become separated from the holder when the clamping screw is loosened to its released position, shown in FIG. 3. In the released position, the various fingers 16, 16 are supported on and depend from the retaining member 20, substantially as shown in FIG. 4. In the latter position, clearance is provided between each finger upper end portion 34 and an associated clamping surface 32. A single finger 16 may be released from the holder 18 by first raising it relative to the holder and then pivoting it laterally outwardly, as indicated by the directional arrows in FIG. 4 which show generally the releasing movements required to release the right hand finger 16.

As previously noted, the retaining member 20 may also serve to target the position of the various fingers, which comprise an assembly, relative to a case or container cell. To vary the lateral pitch of a finger, a retainer 20 may be selected from a group of retainers each having a bearing surface 38 spaced a different radial distance from the axial center of the clamping screw 32. Thus, if a retainer such as the retainer **20*a*, shown in FIG. 4, is selected which has a somewhat greater radial dimension between its clamping surface 38 and the associated axial center of the clamping screw 22, the finger 16 which engages the bearing surface will be pitched laterally outwardly to the broken line position indicated at 16*a*, in FIG. 4. In this manner, the finger assembly 14, 14 may be readily adjusted to form article receiving chutes for articles of varying size. The set screw 46 is loosened to permit the clamping screw and its associated retaining member to be threaded out of assembly with the holder 18, whereby one retaining member 20 may be substituted for another. The illustrated retaining member 20*a* is somewhat larger than the retaining member 20 and may be provided with fluted side walls which generally conform to the fluted lower end of the holder as it appears in FIG. 5, so that the retaining member 20*a* will be disposed with the peripheral boundries of the holder 18**.

We claim:

1. A finger assembly for a case loader and comprising a vertically elongated finger holder having at least one vertically disposed finger receiving slot, said one slot having a blind upper end portion defining a generally downwardly facing clamping surface, said one slot opening laterally outwardly through a side of said holder and downwardly through the lower end of said holder, at least one flexible finger, said one finger received in said one slot and having an end portion received in said blind portion and another portion exposed below and in closely spaced relation to said lower end and defining a generally upwardly facing clamping surface engaging said other portion, a single clamping fastener extending upwardly through said retaining member and engaging said holder, said clamping fastener being movable relative to said holder between clamping and releasing positions, said clamping fastener in its clamping position maintaining said upwardly facing clamping surface and said downwardly facing clamping surface is generally opposing clamping emgagement with sais one finger to releasably retain said one finger in assembly with said holder, said one finger in its clamped condition extending downwardly and outwardly from said holder, said one finger being freely movable out of said slot and out of assembly with said holder when said clamping fastener is in its releasing position and means for adjustably mounting said holder on an associated part of a case loader.

2. A finger assembly for a case loader as set forth in claim 1 including securing means for preventing separation of said clamping fastener from said finger holder.

3. A finger assembly for a case loader as set forth in claim 2 wherein said securing means comprises a retaining screw threadably engaged in said holder and releasably retaining said clamping fastener is connected relation with said holder.

4. A finger assembly for a case loader as set forth in claim 3 wherein said clamping fastener comprises a clamping screw having an annular groove therein and said retaining screw extends into said groove.

5. A finger assembly for a case loader as set forth in either claim 1 or claim 2 wherein said other portion has a downwardly opening notch and said upwardly facing clamping surface engages said one finger within said notch.

6. A finger assembly for a case loader as set forth in claim 5 wherein said upwardly facing clamping surface is spaced radially outwardly from the axis of said clamping screw.

7. A finger assembly for a case loader as set forth in claim 6 wherein said finger retaining member is selected from a group of retaining members each having a different radial spacing between its upwardly facing clamping surface and said axis of said clamping screw.

8. A finger assembly for a case loader as set forth in claim 5 wherein said downwardly facing clamping surface comprises an arcuate surface and said upper end portion has an upwardly facing bearing surface generally complementing said arcuate surface.

9. A finger assembly for a case loader as set forth in claim 1 wherein the part comprises a rail, said means for adjustably mounting said holder comprises a slot extending transversely through said finger holder and receiving the rail therein and a mounting fastener carried by said holder and engaging the rail within sail slot.

10. A finger assembly for a case loader as set forth in claim 9 wherein said slot opens upwardly through the upper end of said holder and said mounting fastener comprises a screw threadably engaged in said holder and extending through said rail.

11. A finger assembly for a case loader as set forth in claim 1 wherein said finger holder comprises an upwardly tapered fluted member characterized by smoothly contoured surfaces.

* * * * *